US005769239A

United States Patent [19]

Thom, Jr. et al.

[11] Patent Number: 5,769,239

[45] Date of Patent: Jun. 23, 1998

[54] GRAIN SCALPING APPARATUS

[75] Inventors: Kelsey C. Thom, Jr., Cedar Falls; Ted D. Waitman, Waverly; Mark Heimann, Dike, all of Iowa

[73] Assignee: Consolidated Process Machinery, Inc., Merrimack, N.H.

[21] Appl. No.: 544,527

[22] Filed: Oct. 18, 1995

[51] Int. Cl.[6] ..... B07B 1/00

[52] U.S. Cl. ..... 209/240; 209/254; 209/317; 209/319; 209/355; 209/393

[58] Field of Search ..... 209/240, 243, 209/246, 254, 256, 315, 316, 317, 319, 352, 353, 355, 356, 363, 393

[56] References Cited

U.S. PATENT DOCUMENTS

| | | | |
|---|---|---|---|
| 1,508,416 | 9/1924 | Sheldon | 209/316 X |
| 2,156,716 | 5/1939 | Beckwith | 209/319 X |
| 2,626,053 | 1/1953 | McIlvaine | 209/256 X |
| 3,752,315 | 8/1973 | Hubach | 209/240 |
| 4,231,861 | 11/1980 | Hannie et al. | 209/240 |
| 4,411,778 | 10/1983 | Venable | 209/246 |
| 5,366,167 | 11/1994 | McCarthy | 241/81 |

FOREIGN PATENT DOCUMENTS

| | | | |
|---|---|---|---|
| 1461529 | 2/1989 | U.S.S.R. | 209/254 |

*Primary Examiner*—Joseph E. Valenza
*Assistant Examiner*—Tuan N. Nguyen
*Attorney, Agent, or Firm*—Nixon & Vanderhye

[57] ABSTRACT

A gravity flow apparatus that scalps off the large pieces of foreign material from grain before processing or storage. The scalper consists of an upright housing with a grain inlet at the top. The grain enters the housing and drops onto a dead head slide. The dead head slide with a flexible baffle slows the momentum of the falling grain then spreads the grain out over the slide width before it enters the screen. The slide is sloped to suit the grain's natural angle of repose and is lined with an anti-friction material for mass flow. The grain enters the full width of the screen while a second baffle stops grain from freely pouring into the foreign material discharge. The screen is adjustable to allow the grain to spread on the screen at its natural angle of repose while trash is scalped off over the screen into the trash discharge.

15 Claims, 4 Drawing Sheets

GRAIN SCALPING APPARATUS

BACKGROUND OF THE INVENTION

This invention relates generally to grain cleaning apparatus and more particularly to gravity flow apparatus that scalps off the large pieces of foreign material from the grain before processing or storage.

Existing sifter designs are used for separating foreign material such as dust, seeds, chaff, etc. from grain. The fine material can cause plugging or obstructing of grain handling equipment such as dryers and storage systems. One prior art stationary sifter is described in U.S. Pat. No. 4,231,861. Prior art sifters have also been used as particle size sifters for ground grain. However, these sifters are not effective in cleaning grain of large pieces of foreign material such as cobs, stones, wood, steel, etc. The large pieces of foreign material can be very destructive to grain processing equipment such as hammermills, roller mills, crushers, etc.

The foregoing illustrates limitations known to exist in present grain scalpers. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a gravity flow scalper for removing trash from feed material, the scalper comprising: a scalper housing having a feed material inlet, a product discharge outlet and a trash discharge; an inclined slide member located within the scalper housing below the feed inlet; a first means for slowing the momentum of feed material falling on the slide member; an inclined feed material screening member located within the scalper housing below the slide member and above the product discharge outlet and extending towards the trash discharge; and a second means for slowing momentum of feed material falling on the feed material screening member.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
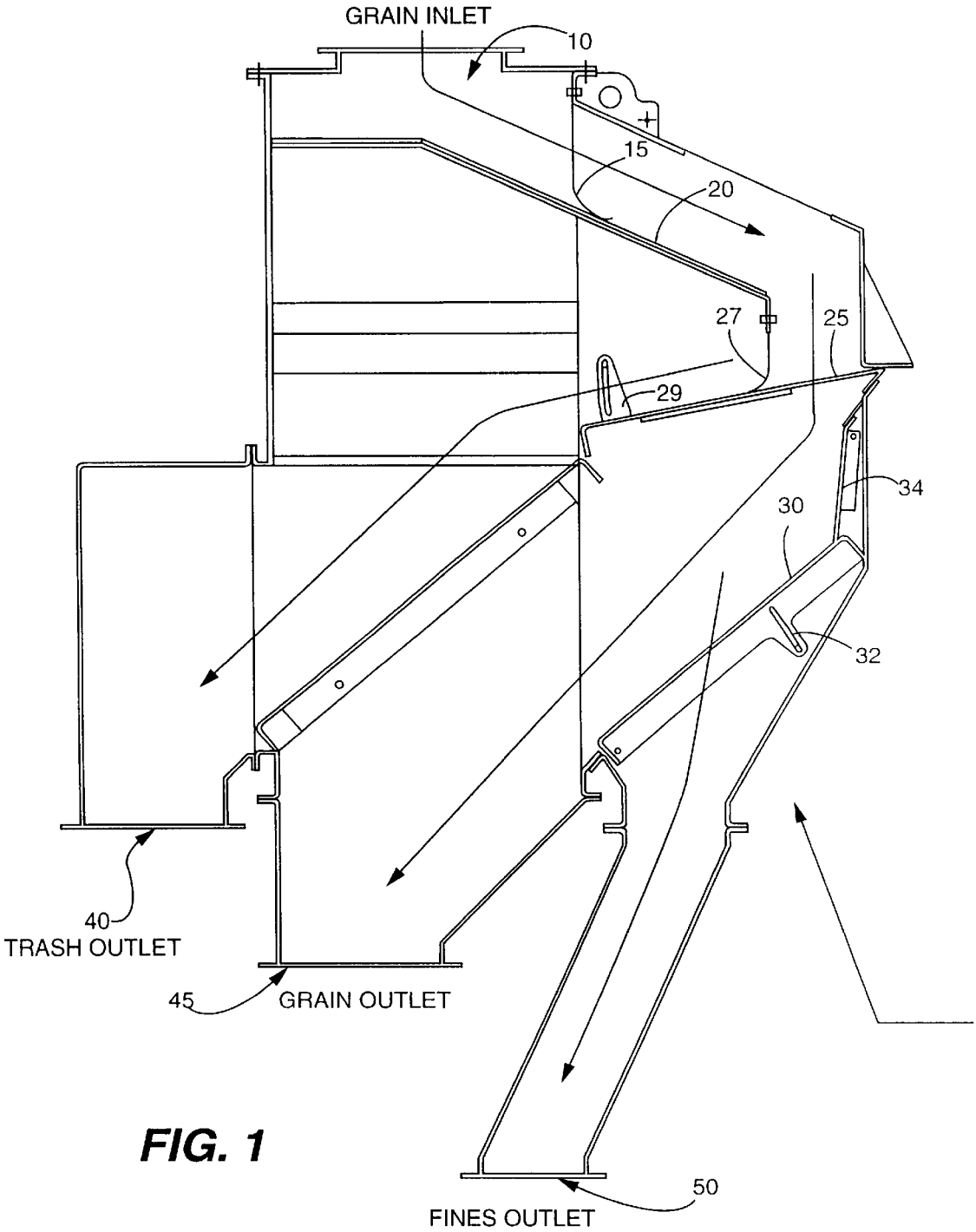
FIG. 1 is cross-sectional view of one embodiment of a grain scalper.

Shown in the FIGURES is a gravity flow apparatus that scalps off the large pieces of foreign material 1 from grain 2 before processing or storage. The scalper consists of an upright housing with a grain inlet 10 at the top. The grain enters the housing and drops onto a dead head slide 20. The dead head slide 20 includes a flexible baffle 15 which slows the momentum of the falling grain and then spreads the grain out over the slide 20 width before the grain enters the screen 25. The slide 20 is sloped to suit the grain's natural angle of repose and is lined with an anti-friction material for mass flow. The grain enters the full width of the screen 25 while a second baffle 27 stops grain from freely pouring into the foreign material discharge 40. The screen 25 is adjustable to allow the grain to spread on the screen 25 at its natural angle of repose while trash 1 is scalped off over the screen 25 into the trash discharge 40.

Figure 2:
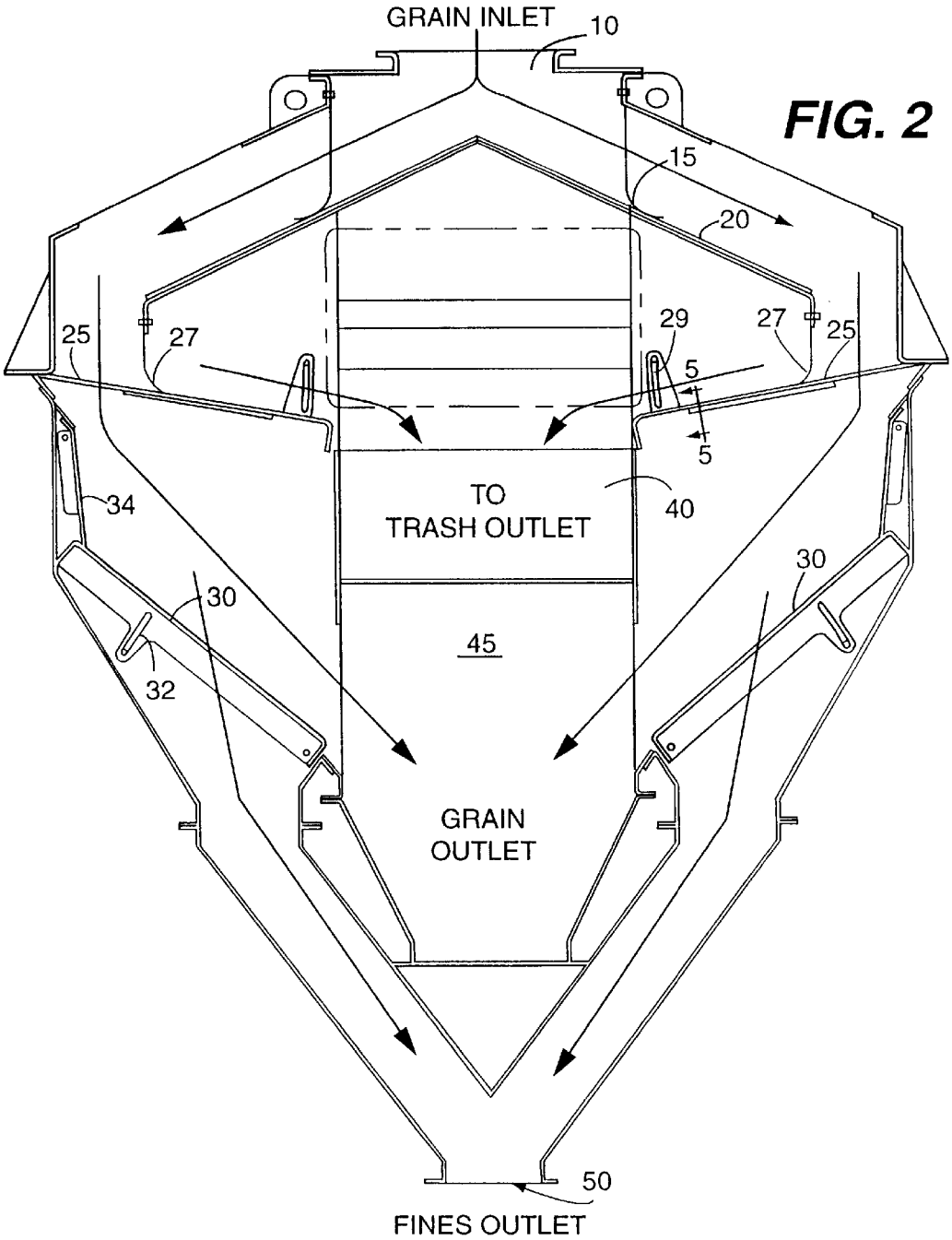
FIG. 2 is a cross-sectional view of a second embodiment of a grain scalper.
Figure 5:
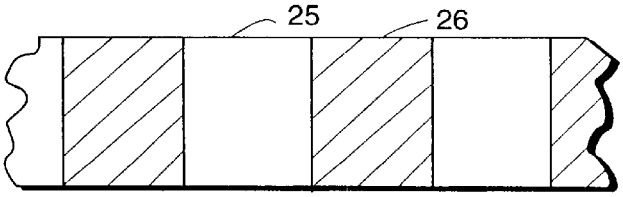
FIG. 5 is a fragmentary enlarged cross-sectional view illustrating uniformly spaced grate bars formed on the screening member and taken generally about on line 5—5 in FIG. 2.
Figure 3:
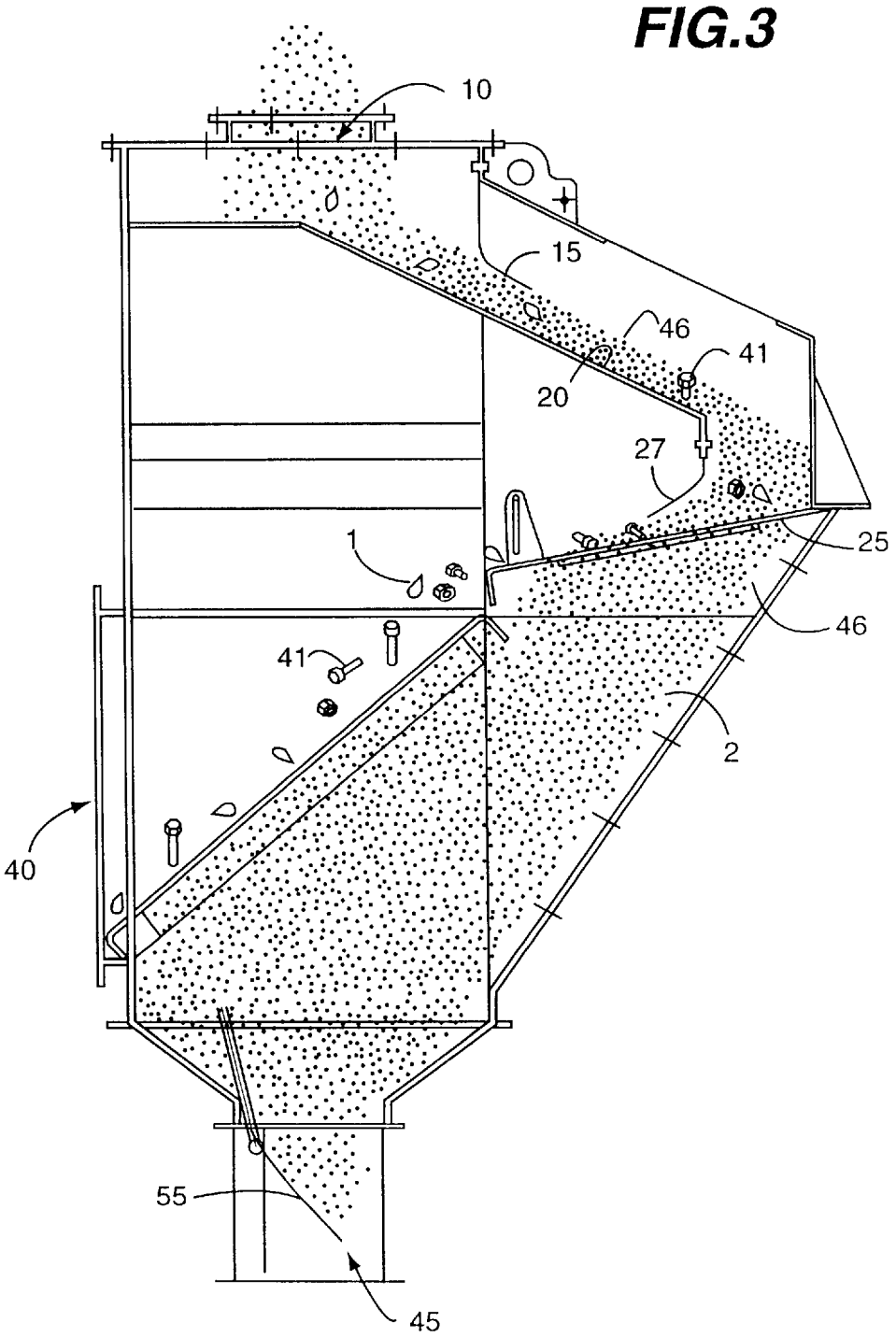
FIG. 3 is a cross-sectional view of a grain scalper showing the distribution of feed material and trash.
Figure 4:
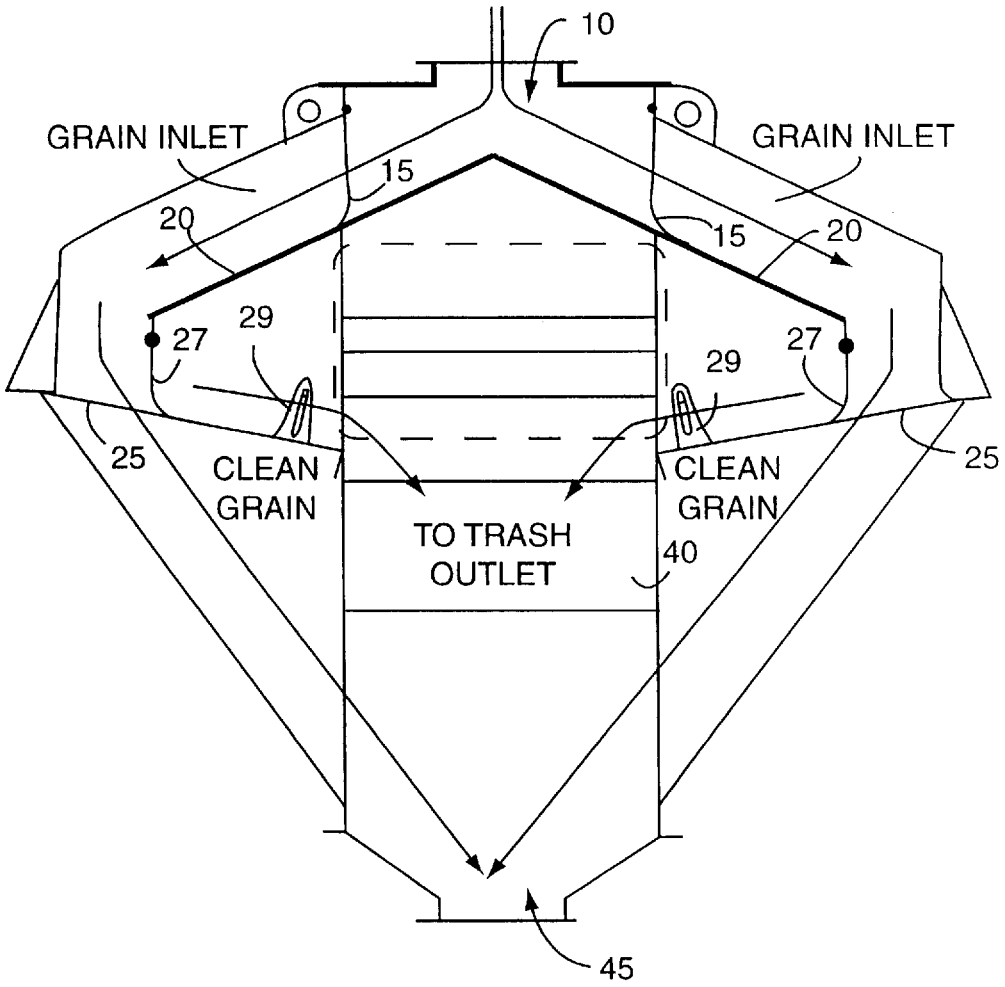
FIG. 4 is a cross-sectional view of a third embodiment of a grain scalper.

The FIGURES show several embodiments of the grain scalper. FIG. 1 shows a single grain scalper with both a grain or feed material screen 25 and a fines screen 30. FIG. 2 shows a double grain scalper with both a feed material screen 25 and a fines screen 30. FIG. 3 shows a single grain scalper with only a feed material screen 25 and including a counter weighted flow control valve 55. FIG. 4 shows a double grain scalper with only a feed material screen 25. The grain scalper can be used in a single unit, double unit or triple unit configuration. Preferably, the multiple unit configurations have a common feed inlet 10 and also have a common trash outlet 40, a common feed material outlet 45 and, if used, a common fines outlet 50.

In operation, grain 2 enters the grain scalper through the feed inlet 10. The grain 2 falls on the inclined slide 20 which is preferably covered with an anti-friction material such as ultra high molecular weight polymer. The anti-friction material keeps the velocity of the falling grain uniform to keep the grain uniformly distributed and prevent it from bunching up. A flexible baffle 15 is disposed in close proximity to the slide 20. The flexible baffle 15 slows the momentum of the grain and levels and distributes the flow of grain over the entire width of the slide 20.

From the end of the slide 20, the grain falls onto feed material screening member 25. Preferably, screening member 25 comprises parallel uniformly spaced grate bars 25 extending from a first end of the feed material screening member 25 toward the trash discharge 40, such as the grate bars described in U.S. Pat. No. 5,366,167. Most of the grain passes through feed material screening member 25. The trash 1 which is larger than the gaps in the feed material screening member 25 and some of the grain 2 continues to move along the screening member 25 towards the trash outlet 40. This separated trash 1 and grain 2 then passes through a second flexible baffle 27 which slows the momentum of the grain and trash down. This allows more time for any remaining grain to continue to fall through feed material screening member 25. The flexible baffle 27 also prevents grain from freely pouring into the trash outlet 40. The screening member 25 is provided with an angle adjustment 29 to adjust the incline of the screening member 25. This permits the screening member 25 to be adjusted to allow the grain to spread over the screening member 25 at its natural angle of repose. From the screening member 25, the trash 1 and any further remaining unseparated grain falls into the trash outlet 40.

As shown in the FIGURES, as the grain falls from the slide 20 to the feed material screen 25, the direction the grain is flowing in changes. On the slide 20, the horizontal component of the direction of the grain is in a first direction. On the feed material screen 25, the horizontal component of the grain is in a second direction which is opposite the first direction. This slows the momentum of the grain further to permit better separation of the trash from the grain. If the grain flows too fast, it can continue on the feed material screen 25 and fall into the trash outlet 40 rather than fall through the screen 25.

As shown in FIGS. 1 and 2, the grain 2 which falls through feed material screening member 25 then falls onto a fines screening member 30 which separates any fine material or dust from the grain 2. The grain slides off the fines screening member 30 and into the feed material outlet 45. The separated fines material falls through the fines screen 30 and into the fines outlet 50. The inclination of the fines screen 30 is also adjustable using adjustment mechanism 32. The fines screen 30 is also preferably a grate as described in U.S. Pat. No. 5,366,167. A pivoted follower 34 is attached to the grain scalper housing and rides on one end of the fines screen 30. This follower 34 prevents any gaps from occurring between the fines screen 30 and the grain scalper housing as the fines screen 30 inclination is adjusted.

Preferably, the grain scalper includes a means for gating the grain 55 out of the feed material outlet 45. This causes the grain 2 to back up into the scalper, as shown in FIG. 3. This build-up of grain on the feed material screen 25 helps to walk trash off the screen 25 and into the trash outlet 40. Without this build-up of grain, it is possible for some trash, such as corn cobs or pieces of corn cob, to become stuck in the screen bars. An additional benefit of a flow control device 55 is preventing the grain from flowing through the grain scalper too fast. If the grain is moving too fast, it again can continue on the feed material screen 25 and fall into the trash outlet 40 rather than fall through the screen 25. Without flow control device 55, the grain falling through the scalper can cause a buildup of fines or dust on screen 25. This buildup of dust then interferes with the operation of the scalper and can trap trash such as a cob on screen 25.

The flow control device 55 shown in FIG. 3 is a simple counter weighted plate which partially closes or chokes off the opening of the feed material outlet 45.

Having described the invention, what is claimed is:

1. A gravity flow scalper for removing trash from feed material, the scalper comprising:

a scalper housing having a feed material inlet, a product discharge outlet and a trash discharge;

an inclined stationary slide member located within the scalper housing below the feed inlet;

a first means for slowing the momentum of feed material falling on the slide member;

an inclined stationary feed material screening member located within the scalper housing below the slide member and above the product discharge outlet and extending towards the trash discharge; and a second means for slowing momentum of feed material falling on the feed material screening member.

2. The scalper according to claim 1, further comprising:

means, on the slide member, for keeping the velocity of the feed material uniform and the feed material uniformly distributed along the slide member.

3. The scalper according to claim 2, wherein the means for keeping the velocity of the feed material uniform is an anti-friction material.

4. The scalper according to claim 1, further comprising:

a means for controlling the flow rate of feed material exiting the product discharge outlet.

5. The scalper according to claim 1, further comprising:

means for adjusting the downward incline of the feed material screening member.

6. The scalper according to claim 1, wherein the feed material screening member comprises parallel uniformly spaced grate bars extending from a first end of the feed material screening member toward the trash discharge.

7. The scalper according to claim 1, wherein the scalper housing has a fines outlet; and an inclined fines screening member is located below the feed material screening member and extends towards the product discharge outlet.

8. The scalper according to claim 7, further comprising:

means for adjusting the downward incline of the fines screening member.

9. The scalper according to claim 7, wherein the fines screening member comprises parallel uniformly spaced grate bars extending from a first end of the fines screening member toward the product discharge outlet.

10. The scalper according to claim 1 wherein the inclined slide member extends in a first downward direction and the inclined feed material screening member extends in a second downward direction, the horizontal component of the first direction being opposite of the horizontal component of the second direction.

11. A gravity flow scalper for removing trash from feed material, the scalper comprising:

a scalper housing having a feed material inlet, a product discharge outlet and a trash discharge;

an inclined stationary slide member located within the scalper housing below the feed inlet;

a first means for slowing the momentum of feed material falling on the slide member;

an inclined feed material screening member located within the scalper housing below the slide member and above the product discharge outlet and extending towards the trash discharge, the inclined slide member extending in a first downward direction and the inclined feed material screening member extending in a downward second direction, the horizontal component of the first direction being opposite of the horizontal component of the second direction;

means for adjusting the downward incline of the feed material screening member;

a second means for slowing momentum of feed material falling on the feed material screening member; and a means for controlling the flow rate of feed material exiting the product discharge outlet.

12. The scalper according to claim 11, wherein the feed material screening member comprises parallel uniformly spaced grate bars extending from a first end of the feed material screening member toward the trash discharge.

13. The scalper according to claim 11, wherein the scalper housing has a fines outlet; and further comprising:

an inclined fines screening member is located below the feed material screening member and extends towards the product discharge outlet; and means for adjusting the downward incline of the fines screening member.

14. The scalper according to claim 13, wherein the fines screening member comprises parallel uniformly spaced grate bars extending from a first end of the fines screening member toward the product discharge outlet.

15. A gravity flow scalper for removing trash from feed material, the scalper comprising:

a scalper housing having a feed material inlet, a product discharge outlet and a trash discharge;

an inclined stationary slide member located within the scalper housing below the feed inlet;

a flexible baffle in close proximity with the slide member;

an inclined stationary feed material screening member located within the scalper housing below the slide member and above the product discharge outlet and extending towards the trash discharge;

means for adjusting the downward incline of the feed material screening member;

a second flexible baffle in close proximity with the feed material screening member; and a means for controlling the flow rate of feed material exiting the product discharge outlet.

* * * * *